United States Patent [19]

Sumiyoshi

[11] 4,303,042

[45] Dec. 1, 1981

[54] WATER HEATER

[75] Inventor: Tateo Sumiyoshi, Sakai, Japan

[73] Assignee: Kabushiki Kaisha Taada, Sakai, Japan

[21] Appl. No.: 78,285

[22] Filed: Sep. 24, 1979

[51] Int. Cl.[3] ..... F22B 5/00

[52] U.S. Cl. ..... 122/17; 122/13 R; 126/361; 126/364; 126/1 F

[58] Field of Search ..... 237/19; 122/17, 15, 122/13 R, 16; 126/364, 361, 1 F

[56] References Cited

U.S. PATENT DOCUMENTS

| | | | |
|---|---|---|---|
| 1,745,206 | 1/1930 | Cahow | 122/13 R |
| 2,462,383 | 2/1949 | Goodwin | 126/1 F |
| 2,888,911 | 6/1959 | Thompson | 122/17 |

FOREIGN PATENT DOCUMENTS

| | | | |
|---|---|---|---|
| 2260759 | 9/1975 | France | 237/19 |

*Primary Examiner*—Albert J. Makay
*Assistant Examiner*—Henry Bennett
*Attorney, Agent, or Firm*—Wenderoth, Lind & Ponack

[57] ABSTRACT

A water heater incorporating a cylindrical heat exchanger installed laterally in the lower part of a water tank. The interior of the heat exchanger has a plurality of circular baffles spaced transversely of the interior. An exhaust pipe covered with a heat insulator extends vertically from the heat exchanger to outside the water tank.

3 Claims, 5 Drawing Figures

WATER HEATER

The present invention relates to a water heater.

With conventional water heaters, an exhaust pipe or pipes passing vertically through the interior of a water tank serve as a heat exchanger. That is, the exhaust pipe or pipes serve for transferring heat from hot exhaust gas to the water surrounding the pipe or pipes in the water tank and thereby serve for raising the temperature of the water. A disadvantage ensuing from this type of water heaters is that, as soon as the burner is turned off, a backward transfer of heat from the hot water in the water tank to the air in the exhaust pipe or pipes occurs. The air heated by this backward transfer of heat rises, causing a rising current of air within the exhaust pipe or pipes and thereby produces a flow of the outside air into the exhaust pipe or pipes. Since the temperature of the outside air is much lower than that of the hot water in the water tank, the backward transfer of heat from the hot water in the water tank to the air in the exhaust pipe or pipes is further accelerated and the temperature of the hot water in the water tank is thereby lowered. The heat loss from the hot water in the water tank is all the greater because the exhaust pipe or pipes passing vertically through the interior of the water tank are attended with a large radiating surface area.

It is an object of the present invention to eliminate the above-mentioned disadvantage.

It is an object of the present invention to provide a water heater with a short heat exchanger installed laterally in the lower part of the water tank so that the heat loss from the hot water in the water tank while the burner is off is minimized.

It is another object of the present invention to provided a water heater in which an exhaust pipe extending vertically from the heat exchanger is placed outside the water tank and covered with a heat insulator. One of the advantages ensuing from the exhaust pipe covered with the heat insulator is that moisture contained in the exhaust gases is prevented from condensing, whereby the possibility of corrosion of the exhaust pipe is precluded and good durability of the exhaust pipe is achieved. The other of the advantages is that the transfer of heat from the hot water in the water tank to the air in the exhaust pipe is prevented from occurring while the burner is off.

It is still another object of the present invention to provide a water heater which achieves such a high thermal efficiency as to permit a large quantity of water to be heated with a small quantity of gas or oil.

With these objects in view, the present invention will be more clearly understood from the following detailed description, the present invention will be more clearly understood in connection with the accompanying drawings, in which.

Figure 1:
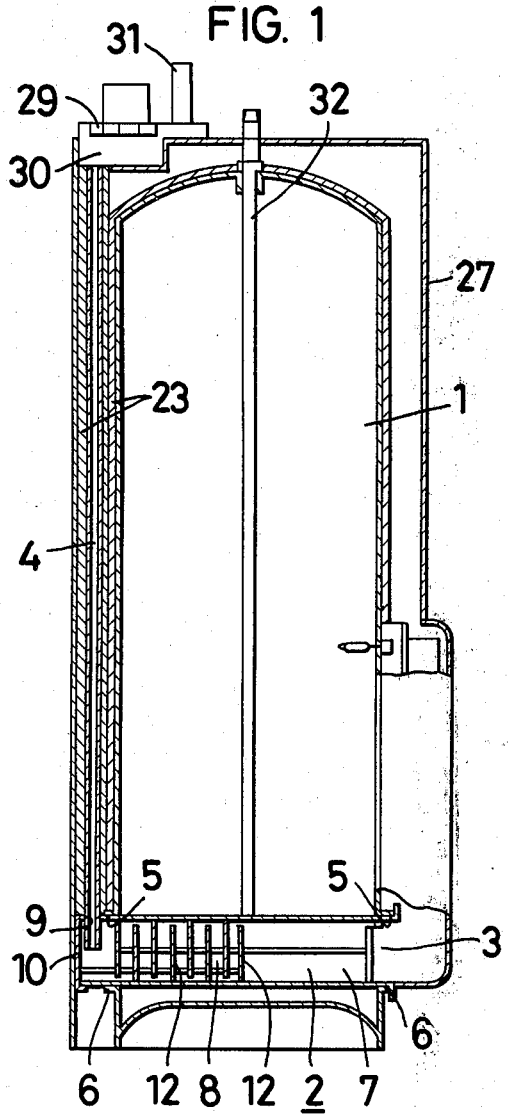
FIG. 1 is a schematic sectional side elevation of a water heater according to the present invention.
Figure 2:
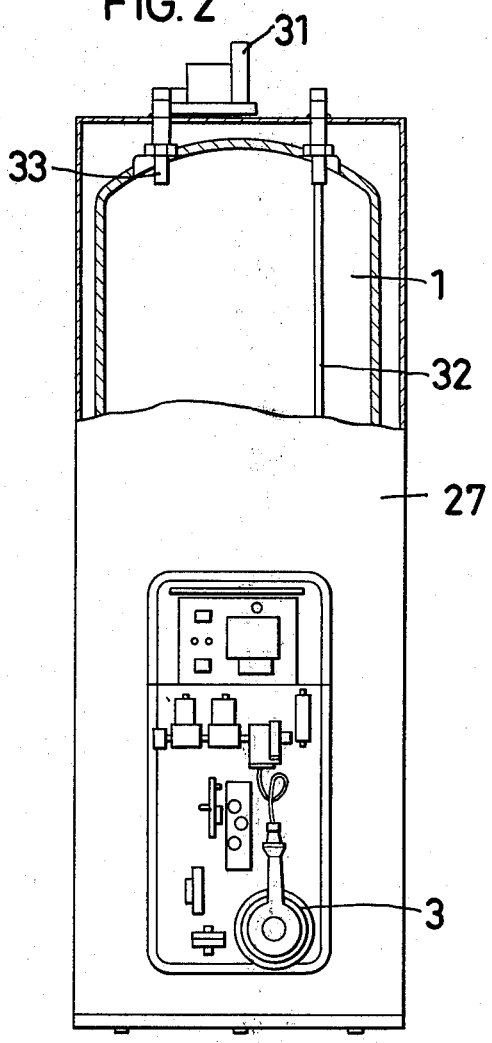
FIG. 2 is a partially cutaway schematic front view thereof.
Figure 5:
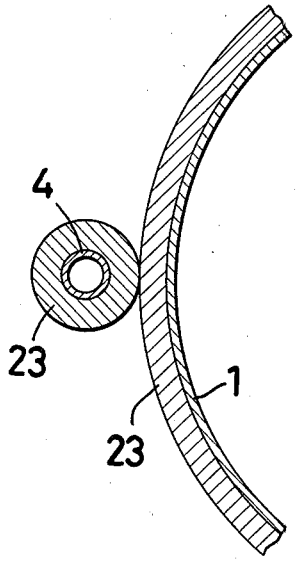
FIG. 5 is a cross-sectional view of an exhaust pipe and a part of the water tank.

Referring now to FIGS. 1, 2 and 5, a water heater in accordance with the present invention includes a water tank 1 covered with heat insulation 23, an outer housing 27 housing the water tank 1, a horizontally positioned substantially cylindrical heat exchanger 2 fitting in holes 5 provided a diametrically opposite positions in the lower part of the water tank 1, a burner housing 3 provided at one end of the heat exchanger 2, and a cover 10 welded to the other end of the heat exchanger 2. Either a gas burner or an oil burner may be installed in the burner housing 3. The heat exchanger 2 may have other shapes than a cylinder. A combustion chamber 7 is provided in the heat exchanger 2 so as to abut on the burner housing 3. An exhaust gas chamber 8 occupies the space between the combustion chamber 7 and the cover 10. The heat exchanger 2 is welded to sleeves 6 provided integrally with the water tank 1 around the edges of the holes 5. The exhaust gas chamber 8 is has a plurality of circular baffles 12 therein which are spaced along and which extend transversely of the chamber 8 and through which the exhaust gases are passed.

An exhaust pipe 4 covered with the heat insulation 23 communicates with the heat exchanger 2 through a hole 9 provided in proximity to the cover 10 and extends vertically from the heat exchanger 2 outside the water tank 1. The upper end of the exhaust pipe 4 has into a chamber 30, from which the exhaust gases are allowed to escape through a vent pipe 31 provided on top of the outer barrel 27. A fan 29 provided on the upper wall of the chamber 30 is adapted to forcibly draw the exhaust gases up into the chamber 30 through the heat exchanger 2 and the exhaust pipe 4.

The water tank 1 and the exhaust pipe 4 can be covered with heat insulation made either of the same material or of different materials.

Figure 3:
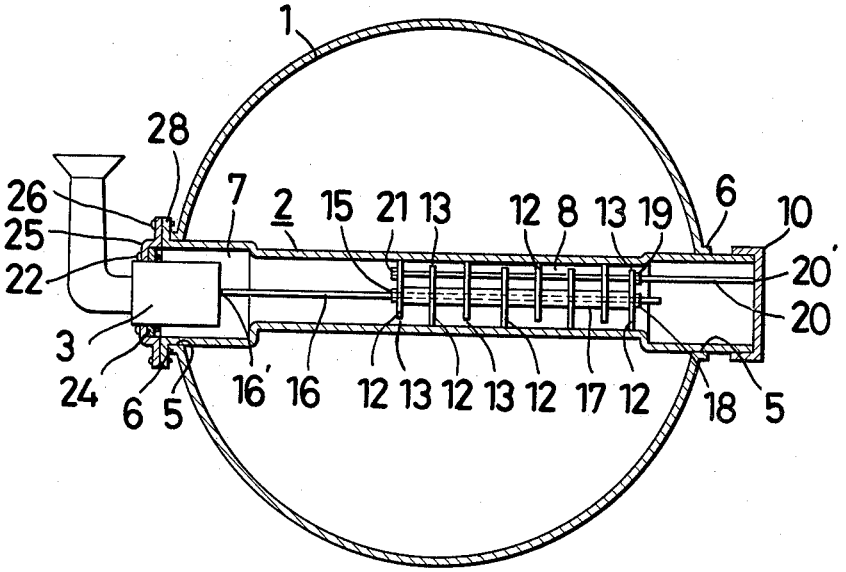
FIG. 3 is a cross-sectional view of the lower portion of a water tank forming a part of the water heater.
Figure 4:
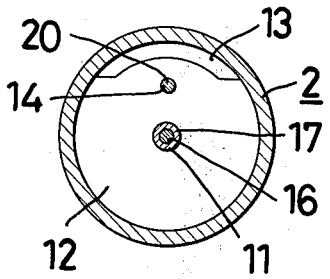
FIG. 4 is a cross-sectional view of a heat exchanger incorporated in the water heater.

Referring now to FIGS. 3 and 4, the diameter of the circular baffles 12 is substantially equal to the inside diameter of the exhaust gas chamber 8. Each circular baffle 12 is provided with holes 11 and 14 so that rods 16 and 20 can extend through an assembly of alternately arranged circular baffles 12 and tubular spacers 17. The rods 16 and 20 extend into the assembly from opposite directions. The rod 20 need not be furnished with the tubular spacers 17. Nuts 18 and 21 are threaded on the rods 16 and 20, respectively, so that the assembly of alternately arranged circular baffles 12 and tubular spacers 17 will be held fast between the nut 18 and a collar 15 provided on the rod 16 on one hand, and between the nut 21 and a collar 19 provided on the rod 20 on the other hand.

In the assembly of alternately arranged circular baffles 12 and tubular spacers 17, an edge aperture 13 provided on the edge of each baffle 12 is positioned diametrically opposite to the apertures 13 provided on the edges of the adjacent baffles 12.

The rods 16 and 20, by which the assembly of alternately arranged circular baffles 12 and tubular spacers 17 is held together, are just long enough to allow their tips 16' and 20' to touch the back side of the burner housing 3 and the inside surface of the cover 10 respectively.

By means of bolts 22, a snap ring 25 fitting on the burner housing 3 is fixed to a flange 24 provided on the outside surface of the burner housing 3. By means of bolts 26, the snap ring 25 is fixed also to an outward flange 28 provided at the open end of the heat exchanger 2.

In operation, water is admitted into the water tank 1 through a water inlet pipe 32, and the fan 29 is switched on. Then the burner in the burner housing 3 is ignited.

The fan 29 forcibly draws the exhaust gases into the chamber 30, and the exhaust gases are allowed to escape through the exhaust pipe 31.

At the same time, the supply of air required for the combustion of gas or oil is obtained by the forced admission of outside air into the burner housing 3 through an air intake hole (not shown) provided at the bottom of the burner housing 3. The temperature of water in the proximity of the burner housing 3 is raised by the heat transferred from hot air in the burner housing 3. Heated water is circulated by convection within the water tank 1. The temperature of the water is also raised by the heat transferred from hot exhaust gas passing through the heat exchanger 2 to the water surrounding the heat exchanger 2. Because the aperture 13 provided on the edge of each baffle 12 is positioned diametrically opposite to the apertures 13 provided on the edges of the adjacent baffles 12, the hot exhaust gas is caused to pass through the heat exchanger 2 in a zigzag direction so that a long traveling distance in the short heat exchanger 2 is provided for the hot exhaust gas. Thus the effectiveness of the heat exchanger 2 amounts to 50 to 80 kcal/$m^3$.hr.deg as compared with 10 to 30 kcal/$m^3$.hr.deg in the conventional CF type water heaters. Hot water is delivered through a hot water outlet pipe 33.

The water heater in accordance with the present invention has an advantage that heat loss sustained by the hot water surrounding the heat exchanger 2 while the burner is off does not influence the temperature of the hot water in the upper part of the water tank 1.

While we have disclosed a few embodiments of the present invention, it is to be understood that they have been given by way of example only and not in a limiting sense, the scope of the present invention being determined by the objects and the claims.

What we claim is:

1. A water heater comprising:

a vertically extending water tank;

a substantially cylindrical heat exchanger positioned horizontally in said water tank and extending diametrically across the lower part of said water tank and spaced above the bottom of said tank, said heat exchanger having an open end secured in water tight relation in the wall of said water tank on one side of said tank and having a closed end projecting out of the wall of said tank on the other side of said tank in water tight relation therewith, said heat exchanger having a combustion chamber adjacent the open end and an exhaust gas chamber cocupying the space between said combustion chamber and the closed end of said heat exchanger;

a burner directed into said combustion chamber from the open end thereof;

a baffle assembly removably fitted into said exhaust gas chamber and having a plurality of circular baffles extending transversely of said heat exchanger and spaced along the length of said exhaust gas chamber, each baffle having an aperture in the edge thereof positioned diametrically opposite the corresponding apertures in the edges of adjacent baffles, a plurality of cylindrical spacers extending between adjacent baffles, and a rod extending through said baffles and said spacers and secured to the end baffles at the opposite ends of said assembly; and an exhaust pipe communicating with said heat exchanger at the closed end thereof and extending vertically therefrom outside said water tank, said exhaust pipe being covered with a heat insulating material.

2. A water heater as claimed in claim 1 in which said rod extends beyond one end of said assembly and abuts a part of the structure of said water heater for maintaining said assembly in position in said heat exchanger.

3. A water heater as claimed in claim 2 in which said rod extends toward said one end of said heat exchanger for abutting the structure associated with said burner, and said assembly further comprises a second rod extending through said baffles and secured to the end baffles in the assembly and extending to and abutting the closed end of said heat exchanger for further positioning said assembly in said heat exchanger.

* * * * *